US006532765B1

(12) United States Patent
Hurwitz

(10) Patent No.: US 6,532,765 B1
(45) Date of Patent: Mar. 18, 2003

(54) JEWELRY STONE ASSEMBLY

(75) Inventor: Robert Hurwitz, Ridgewood, NJ (US)

(73) Assignee: Sandberg & Sikorski Diamond Corp., New York, NY (US)

( * ) Notice: Subject to any disclaimer, the term of this patent is extended or adjusted under 35 U.S.C. 154(b) by 709 days.

(21) Appl. No.: 08/879,392

(22) Filed: Jun. 20, 1997

Related U.S. Application Data

(60) Provisional application No. 60/042,225, filed on Apr. 15, 1997.

(51) Int. Cl.[7] ..... A44C 17/02

(52) U.S. Cl. ..... 63/26; 63/15; 63/28; D11/26; D11/91

(58) Field of Search ..... 29/10; 63/15, 26, 63/27, 28; D11/26, 91

(56) References Cited

U.S. PATENT DOCUMENTS

| | | | | | |
|---|---|---|---|---|---|
| 255,677 | A | * | 3/1882 | Rothschild | 63/26 |
| 1,024,048 | A | * | 4/1912 | Abel | 63/26 |
| 1,056,414 | A | * | 3/1913 | Hexter | 63/28 X |
| 1,064,152 | A | * | 6/1913 | Meyer | 63/27 |
| 1,276,132 | A | * | 8/1918 | Suderov | 63/28 X |
| 1,449,158 | A | * | 3/1923 | Wittstein | 63/26 X |
| 1,864,371 | A | | 6/1932 | Prussian | |
| 2,222,061 | A | * | 11/1940 | Augat | 63/29.1 |
| 2,749,597 | A | | 6/1956 | Fus | |
| 2,811,024 | A | | 10/1957 | Thompson | |
| 4,936,115 | A | | 6/1990 | Mesica | |
| 4,972,685 | A | | 11/1990 | Pöll | |
| 5,044,177 | A | | 9/1991 | Favre | |
| 5,056,337 | A | | 10/1991 | Nhaissi | |
| 5,090,217 | A | | 2/1992 | Beber et al. | |
| 5,218,839 | A | | 6/1993 | Udko | |
| 5,649,434 | A | * | 7/1997 | Itzkowitz | 63/26 |

FOREIGN PATENT DOCUMENTS

| | | | | |
|---|---|---|---|---|
| FR | 2367445 | * | 6/1978 | 63/27 |
| FR | 2493115 | * | 5/1982 | 63/26 |
| GB | 121899 | * | 1/1919 | 63/26 |
| GB | 432074 | * | 7/1935 | 63/28 |
| GB | 588891 | * | 6/1947 | 63/26 |
| GB | 2026303 | * | 2/1980 | 63/26 |

* cited by examiner

*Primary Examiner*—J. J. Swann
*Assistant Examiner*—Andrea Chop
(74) *Attorney, Agent, or Firm*—Gottlieb, Rackman & Reisman, P.C.

(57) ABSTRACT

A jewelry assembly which creates the appearance of a space between one or more diamonds or other stones and the supporting jewelry article is provided. The jewelry article is integrally formed with an internal frame for defining a window therewithin. At least one jewelry stone or gem is invisibly set with the window such that an annular space is defined between the one or more stones and the frame of the jewelry article.

14 Claims, 2 Drawing Sheets

FIG. 5
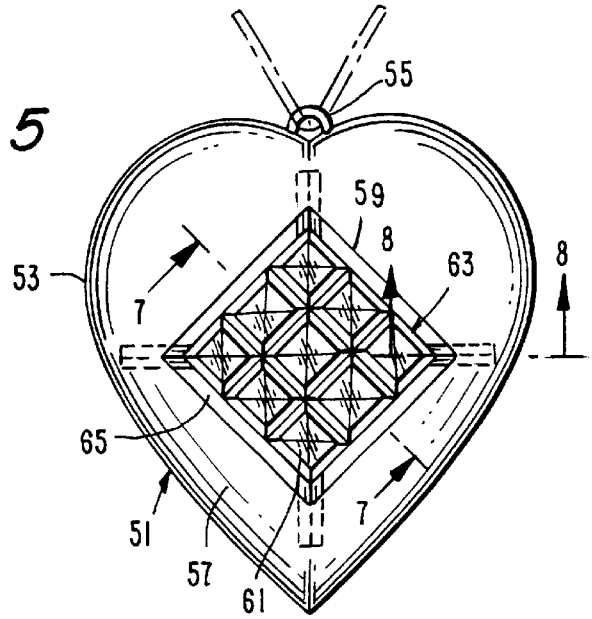
FIG. 6
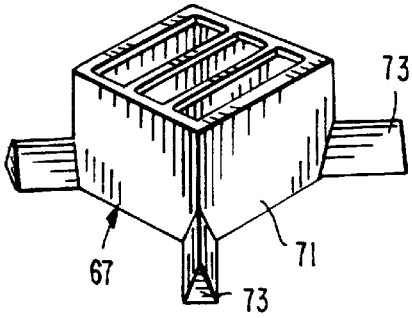
FIG. 7
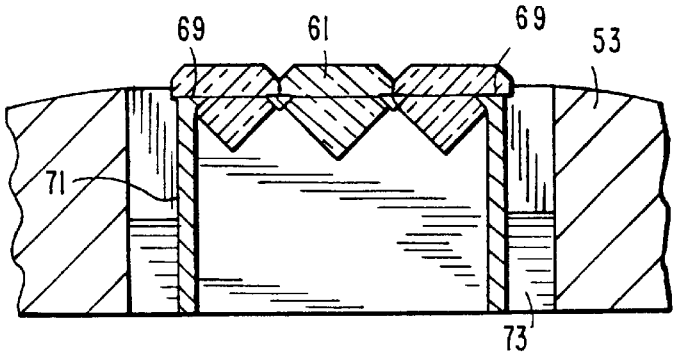
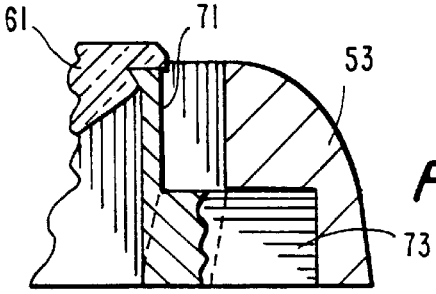
FIG. 8

JEWELRY STONE ASSEMBLY

This application claims the benefit of U.S. Provisional Application No. 60/042,225, filed Apr. 15, 1997.

BACKGROUND OF THE INVENTION

This application describes a jewelry assembly, and more particularly, a jewelry assembly in which the appearance of an air space between one or more diamonds or other jewelry stones and the supporting jewelry article is achieved.

Prior art settings for diamonds and other precious and semi-precious stones generally include a conventional "box-setting" in which the metal holding the diamond is visible. This obviously interferes with the overall aesthetic presentation of the jewelry article.

Recently, a process has been developed to create an "invisible" jewelry stone setting in which the diamond or other gem is cut below the girdle thereof. The cuts below the girdle provide a mechanism for invisibly mounting the stone. While this invisible setting technique provides an improved aesthetic presentation of the stones of a jewelry article, it is often necessary to use stones of substantial size in order to create the desired effect. This is obviously quite costly, and may preclude the average consumer from purchasing a jewelry article with invisibly cut diamonds or other stones.

Accordingly, it would be desirable to provide a jewelry article with one or more invisibly cut stones which create the appearance of a larger stone while reducing manufacturing costs.

SUMMARY OF THE INVENTION

Generally speaking, in accordance with the invention, a jewelry assembly which creates the appearance of a space between one or more diamonds or other stones and the supporting jewelry article is provided. The jewelry article is integrally formed with an internal frame for defining a window therewithin. At least one jewelry stone or gem is invisibly set with the window such that a space is defined between the one or more stones and the frame of the jewelry article.

In one embodiment, the jewelry stone is set into a hidden metal box located rearwardly of the setting area using an invisible setting technique. The box is then attached to the jewelry article itself by means of supporting fingers depending from the rear corners of the box.

In an alternative embodiment, a plurality of stones is arranged in a particular configuration or array, and the metal of the jewelry article surrounding this plurality of stones is separated therefrom by an air space. As with the first embodiment, a number of supporting fingers depend from the bottom corners of one or more of the invisible setting boxes in order to attach the stone array to the surrounding jewelry article, while at the same time giving the appearance of a space between the plurality of stones and the article.

The jewelry article may be a ring, a necklace, a bracelet, a pendant, or any other type of jewelry piece.

Accordingly, it is an object of this invention to provide an improved jewelry design assembly.

Another object of the invention is to provide a jewelry design assembly which creates the appearance of a space between one or more stones and the surrounding supporting jewelry article.

Yet a further object of the invention is to provide a jewelry design assembly which has an enhanced gem or stone presentation.

Still a further object of the invention is to provide a jewelry design assembly in which the set stones are securely held within the jewelry article.

Still other objects and advantages of the invention will in part be obvious and will in part be apparent from the following description.

The invention accordingly comprises a jewelry design possessing the features, properties and relation of components which will be exemplified in the designs hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 5 is a top plan view illustrating a second embodiment of a jewelry article of the invention;

FIG. 6 is a perspective view illustrating the jewelry stone setting used in the jewelry article depicted in FIG. 5;

FIG. 7 is a cross-sectional view taken along lines 7—7 of FIG. 5;

FIG. 8 is a cross-sectional view along lines 8—8 of FIG. 5;

DETAILED DESCRIPTION OF THE PREFERRED EMBODIMENT

Figure 1:
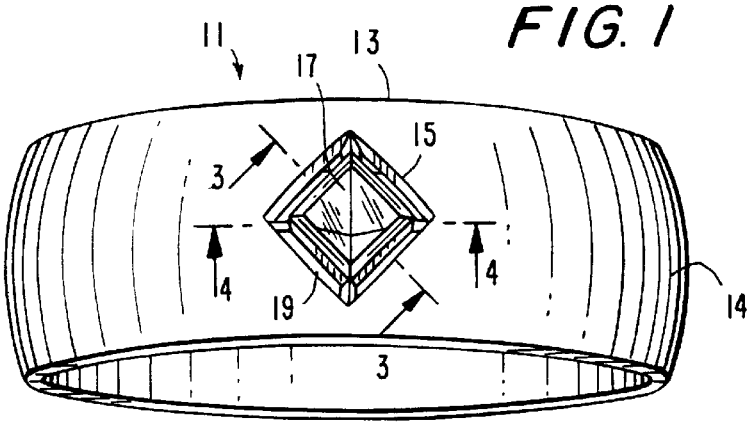
FIG. 1 is a top plan view illustrating a first embodiment of a jewelry article of the invention.

Referring first to FIG. 1, a ring assembly made in accordance with the invention, and generally indicated at 11, is described. Ring assembly 11 comprises a band 13 sized to fit around a wearer's finger having an outer annular surface 14 which includes a centrally disposed square-shaped window defined by a border or frame 15. Frame 15 receives an invisibly set squared jewelry stone 17, such as a diamond, and is separated all around from frame 15 of band surface 14 by a space 19.

Figure 2:
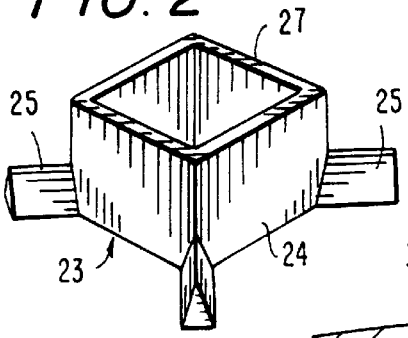
FIG. 2 is a perspective view illustrating the jewelry stone setting used in the jewelry article depicted in FIG. 1.
Figure 3:
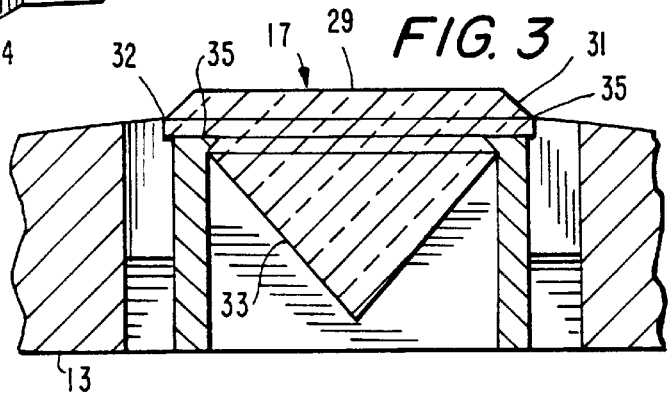
FIG. 3 is a cross-sectional view taken along lines 3—3 of FIG. 1.
Figure 4:
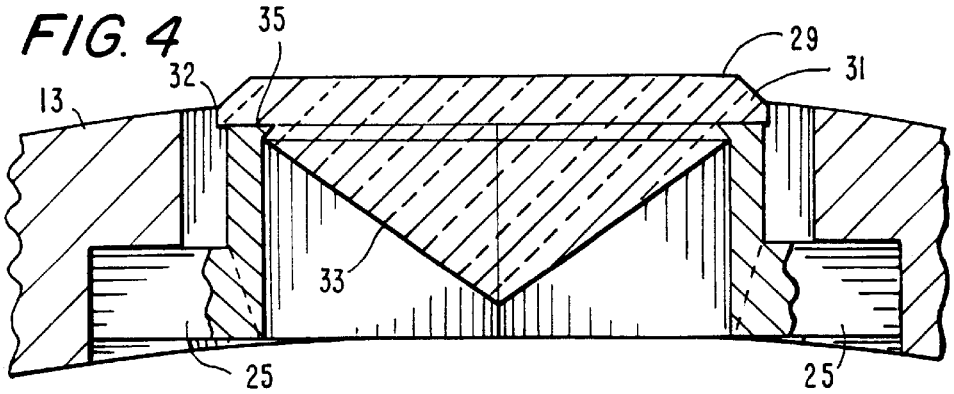
FIG. 4 is a cross-sectional view along lines 4—4 of FIG. 1.

As best depicted in FIGS. 2–4, stone 17 is invisibly set within window 16 by means of a hidden metal box 23. As in well known in the art, stone 17 comprises a table or top portion 29, a girdle portion 31 which terminates to an outer circumference 32, and a pavilion portion 33 formed below girdle portion 14. In order to invisibly set stone 17 within metal box 23, a plurality of grooves 35 are formed in pavilion portion 33 just below girdle portion 31 of stone 17. Depending upon the specific design, groves 35 may comprise two pairs of grooves, with the grooves of each pair disposed opposite each other, thereby providing a total of four grooves formed at substantially the same level in pavilion portion 33 of stone 17.

Referring still to FIG. 2, metal box 23 comprises a squared structure 24, preferably of deformable metal, of a size slightly smaller than circumference 32 of stone 17. Metal box 23 is open at the top and thereby defines a square-shaped lip 27 which is sized for supporting stone 17 along grooves 35, as best shown in FIGS. 3 and 4. In other words, stone 17 is set by press-fitting into metal box 23 such that lip 27 snap fits into grooves 35. As can be appreciated, by setting stone 17 in this manner, no metal used for holding stone 17 will be seen by the wearer, and an extraordinary brilliance will attach to the stone when viewed.

Turning now to FIGS. 2 and 4, metal box 23 further includes a plurality (four) of fingers 25 which depend from the bottom corners thereof. Each of fingers 25 is attached at their ends to ring band 13 by a conventional soldering technique. As a result, since the diamond stone 17 is invisibly set in metal box 23, which in turn is fixed to ring band 13, stone 17 will appear to be "floating" within the window defined by frame 165 This creates a very desirable aesthetic appearance, and will, in fact, produce the illusion that stone 17 is larger than its actual size.

Turning now to FIGS. 5–8 a second embodiment of the inventive jewelry design assembly is now described. In this embodiment, there is provided a pendant assembly made in accordance with the invention, and generally indicated at 51. Pendant assembly 51 comprises a heart-shaped pendant member 53 sized to be carried by a chain or necklace disposed through a hook element 55. Pendant member 53 has a top surface 57 which includes a centrally disposed square-shaped window defined by a border or frame 59. Frame 59 receives a plurality of invisibly set square jewelry stones 61, such as a diamond, in order to define a jewelry stone array generally indicated at 63. Jewelry stone array 63 is separated all around from frame 59 of top surface 57 by a space 65.

As best depicted in FIGS. 7 and 8, stones 61 of array 63 are invisibly set within the window defined by frame 59 by means of a hidden metal box 67. As before, in order to invisibly set stones 61 within metal box 67, a plurality of grooves 69 are formed in the pavilion portion of each of stones 61 just below the girdle portion.

Referring still to FIG. 6, metal box 67 comprises a squared structure 71, preferably made of deformable metal, and of a size slightly smaller than that of array 63. Metal box 67 includes a plurality of box members 73, each of which is open at the top thereof, thereby defining a plurality of squared lips which are sized for supporting stones 61 of array 63 along grooves 69 thereof, as best depicted in FIG. 7. As can be appreciated, by setting stone 61 of array 63 in this manner, no metal used for holding stones 61 will be seen by the wearer, and an extraordinary brilliance will attach to the array when viewed.

Turning now to FIGS. 6 and 8, metal box 67 further includes a plurality of fingers 73 which depend from the bottom corners thereof. Each of fingers 73 is attached pendant member 53 by a conventional soldering technique. As a result, since diamonds 61 of array 63 is invisibly set in metal box 67, which is in turn fixed to pendant member 63, stone 61 will appear to be "floating" within the window defined by frame 59. As before, a very desirable aesthetic appearance is achieved, producing the illusion that stone array 63 is larger than its actual size.

It will thus be seen that the objects set forth above, among those made apparent from the preceding description, are efficiently attained, and, since certain changes may be made in the described design and the construction set forth, without departing from the spirit and scope of the invention, it is intended that all matter contained in this description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A jewelry assembly comprising:

a jewelry article having a facing metal surface including an inside edge for defining a window and an outside edge, said facing metal surface defining a metal surface area; and an internal frame disposed in said window; and at least one jewelry stone for defining a jewelry stone presentation and set within said window by said frame, said jewelry stone presentation and said window cutout having substantially the same shape and being sized and arranged to define a similarly shaped facing empty space framed around said stone presentation, said empty space having a substantially uniform width defined between said stone presentation and said inside edge, said width being smaller than any distance between said inside edge and said outside edge and being arranged and sized to give a viewer the illusion that said stone presentation is larger than its actual size.

2. The assembly of claim 1, wherein said at least one jewelry stone comprises a plurality of jewelry stones for defining a jewelry stone array.

3. The jewelry assembly of claim 2, wherein said jewelry stone array has a configuration substantially the same as said window cutout.

4. The jewelry assembly of claim 1, wherein said at least one jewelry stone is set within a metal box disposed within said window.

5. The assembly of claim 4, wherein said metal box has a bottom which includes a plurality of fingers outwardly depending therefrom and fixed to said internal frame for supporting said at least one jewelry stone within said window.

6. The assembly of claim 1, wherein said at least one jewelry stone is invisibly set in said window.

7. The assembly of claim 6, wherein said at least one jewelry stone is invisibly set within a metal box disposed within said window.

8. The assembly of claim 7, wherein said metal box has a bottom that includes a plurality of fingers outwardly depending therefrom and fixed to said internal frame.

9. The assembly of claim 1, wherein said at least one jewelry stone comprises a table, a girdle, an outer circumference and a pavilion.

10. The assembly of claim 9, wherein said pavilion of said jewelry stone includes a plurality of grooves formed just below said circumference.

11. The assembly of claim 10, wherein said at least one jewelry stone is supported within said window along said plurality of grooves.

12. The assembly of claim 10, further including at least one open metal box for receiving and supporting at least said one jewelry stone, wherein said at least one metal box includes an upper lip with which said plurality of grooves of said at least one jewelry stone are engaged in order to support said at least one jewelry stone within said window of said article.

13. The assembly of claim 1, further including at least one open metal box for receiving and supporting at least said one jewelry stone.

14. The assembly of claim 1, wherein said at least one jewelry stone has a table and said facing metal surface is substantially parallel to said table.

* * * * *